United States Patent [19]

Kuhn et al.

[11] Patent Number: 4,659,438

[45] Date of Patent: Apr. 21, 1987

[54] PROCESS FOR THE TREATMENT OF STAINLESS STEEL FOR A DIRECT GALVANIC GOLD PLATING

[75] Inventors: Werner Kuhn; Wolfgang Zilske, both of Hanau, Fed. Rep. of Germany

[73] Assignee: Degussa Aktiengesellschaft, Frankfurt am Main, Fed. Rep. of Germany

[21] Appl. No.: 263,705

[22] Filed: May 14, 1981

[30] Foreign Application Priority Data

May 29, 1980 [DE] Fed. Rep. of Germany ..... 3020371

[51] Int. Cl.[4] ..... C25D 5/36

[52] U.S. Cl. ..... 204/34; 204/145 R

[58] Field of Search ..... 204/32 R, 34, 46 G, 204/141.5, 145 R

[56] References Cited

U.S. PATENT DOCUMENTS

| | | | |
|---|---|---|---|
| 2,915,444 | 12/1959 | Meyer | 204/145 |
| 2,973,307 | 2/1961 | Hahn | 204/34 |
| 3,551,302 | 12/1970 | Woods et al. | 204/32 |
| 3,642,586 | 2/1972 | Shepard et al. | 204/34 |
| 3,694,326 | 9/1972 | McCabe et al. | 204/29 |
| 4,078,977 | 3/1978 | Fountain | 204/32 R |
| 4,168,214 | 9/1979 | Fletcher . | |

FOREIGN PATENT DOCUMENTS

| | | |
|---|---|---|
| 2642816 | 3/1977 | Fed. Rep. of Germany . |
| 59022 | 3/1967 | German Democratic Rep. . |
| 94539 | 12/1972 | German Democratic Rep. . |

OTHER PUBLICATIONS

*Metal Finishing,* Sep. 1970, p. 77.

*Metal Finishing Guidebook and Directory* 1978, Metals and Plastics Publications, Inc., Hackensack, N.J. pp. 128–131.

*Primary Examiner*—John F. Niebling

*Assistant Examiner*—William T. Leader

*Attorney, Agent, or Firm*—Cushman, Darby & Cushman

[57] ABSTRACT

For the direct gold plating of stainless steel parts in acid baths there is needed a pretreatment of the parts. Known processes operate with corrosive media such as strong acids and attack the surface. These disadvantages are avoided by putting the stainless steel part in an electrolytic, aqueous solution and first treating cathodically and subsequently anodically.

19 Claims, No Drawings

PROCESS FOR THE TREATMENT OF STAINLESS STEEL FOR A DIRECT GALVANIC GOLD PLATING

BACKGROUND OF THE INVENTION

The invention is directed to a process for the pretreatment of stainless steel, especially chrome-nickel steels for a direct electrolytic (galvanic) gold plating with strongly acid baths.

The electrolytic deposition of good adhering metal coatings on rust free, highly alloyed steels always has presented great difficulties through the difficult to remove impervious passive layer. Determinative for the passive behavior of these steels is a quickly forming coating layer, preponderantly of $Cr_2O_3$, a very difficultly soluble oxide. For this reason for the preparation of the stainless steel there must be carried out before the electrolysis a removal of the passive layer by etching in corrosive mineral acids, partially under the influence of a current. Thus for examples it is recommended to use for this purpose 10–20 vol. % of concentrated $HNO_3$ with 1–2 vol. % of concentrated $H_2F_2$ at 50° C., or to employ $H_2SO_4$, $CrO_3$ and $H_2F_2$ at room temperature, or to activate the parts cathodically in various acids. However, almost all processes attack the base material which is undesired particularly with high gloss polished parts. There are further problems with these known processes if there are present stainless steel objects with parts, e.g. of German silver or copper, worked into them. Almost all of these processes also cause considerable corrosion problems in the electrolytic plants.

There are also known activating processes with deposition of an intermediate layer, usually nickel, from a strong hydrochloric acid solution. However, these likewise have distinct disadvantages. Besides corrosion problems in using these baths the so activated and subsequently gold plated parts are substantially more susceptible to corrosion than directly gold plated parts. Starting with faults the nickel intermediate layer corrodes until there is complete separation of the gold superimposed layer. With jewelry parts that are worn directly on the skin a nickel under layer is undesired because of allergic reactions of individual people and perhaps cancerogenic action.

To avoid the undercoating with nickel there have been attempts to activate stainless steel parts directly in the gold bath. Fletcher U.S. Pat. No. 4,168,214 describes a gold bath based on a "dilute aqua regia" which is in a position to activate stainless steel directly in the bath. However, the bath likewise has the disadvantage that it attacks the surface, especially at soldered places. Besides the bath is bad to handle since the corrosiveness increases with time of operation. (The entire disclosure of Fletcher is hereby incorporated by reference and relied upon.) In only a few cases other known strongly acid gold baths for direct coating of stainless steel result in a sufficient adhesion of the gold layer. If the steel part to be coated, for example watch bands, was subjected to for example tempering, soldering, polishing with development of heat, treating in passivating dips or electropolishing before a treatment would be applied underneath which permits formulation of a strongly passive layer, there could not be produced sufficient adhesiveness through direct gold plating.

Therefore, it was the problem of the present invention to develop a process for the pretreatment of stainless steel for a direct electrolytic (galvanic) gold plating in a strongly acid gold bath (e.g. a bath on the basis of KAu (CN/x) containing a mineral acid like phosphoric- or sulfuric acid) which attacks the metal surface as little as possible and produces a good adhesiveness of the deposited gold coatings.

SUMMARY OF THE INVENTION

This problem was solved according to the invention by placing the stainless steel part in an aqueous cyanide solution and then first treating cathodically and subsequently anodically.

Surprisingly it has been found that in treating stainless steel parts, which are present in a strongly passive condition, in a solution of an alkali cyanide (e.g. sodium cyanide or potassium cyanide) after first cathodic, then anodic polarity at room temperature (e.g. about 20° C.) even at low current densities there was produced a good activation. After direct subsequent gold plating in a commercial strongly acid gold bath there were produced very good adhesivenesses. The same activation results can be reached even with visibly tarnished coatings if the cyanide is employed advantageously directly in a commercial defatting bath and there is maintained the mentioned sequence of polarity.

According to the process of the invention there can even be treated stainless steel objects with worked in parts of, e.g. German silver or copper. They can be gold plated subsequently while completely retaining the adhesiveness of the surface finish.

Preferably the pretreatment baths contain the alkali cyanide in a concentration of 2–100 g/l. Besides they can contain still further additives, as e.g. phosphates, condensed phosphates, carbonates and silicates of the alkali metals in various concentrations. These bath components preponderantly are for the defatting and have no influence on the activation. Higher concentrations of an alkali hydroxide, e.g. sodium hydroxide or potassium hydroxide are to be avoided.

Advantageously the activation takes place at temperatures of 20° to 70° C. and is preponderantly carried out at room temperature. It consists of a first cathodic treatment preferably at 2–40 A/dm$^2$ for 15 seconds to 5 minutes and a subsequent anodic treatment under the same conditions.

The use of higher temperature up to about 70° C. and higher current density is possible but not required. For the subsequent direct gold plating there is suited any commercial strongly acid gold bath having a pH below 3. A pickling after the activation, e.g. in 10% sulfuric acid favorably affects the intermediate rinsing but has no influence on the true activation.

Unless otherwise indicated all parts and percentages are by weight.

The process can comprise, consist essentially of or consist of the recited steps with the stated materials.

The following examples explain the pretreatment process in greater detail.

DETAILED DESCRIPTION

Example 1

10 grams of KCN, 10 grams of NaOH, 30 grams $Na_2CO_3$ and 50 grams of $Na_3PO_4.12H_2O$ were dissolved in water to make 1 liter.

A sample of V4A steel polished to high gloss was treated in this bath for 1 minute at room temperature and 10 A/dm$^2$ cathodically and subsequently anodically under the same conditions, rinsed well intermediately and gold plated in a commercial strongly acid gold bath.

The gold coating deposited is high gloss and adheres well. It is not removed even by brushes after sharp levels of the sample.

Example 2

A sample of V4A steel was passivated in known manner by tempering for 1 hour at 300° C. in air.

After treating the sample in a bath according to Example 1 under the conditions stated in that example, there was likewise produced very good adhesiveness in the gold plating.

Example 3

20 grams of NaCN, 10 grams of NaOH, 10 grams of $Na_4P_2O_7.10H_2O$, 30 grams of $Na_2SiO_3.5H_2O$ and 0.5 grams of wetting agent were dissolved in water to make 1 liter.

An electropolished stainless steel braided bracelet having a watch housing of German silver was activated in this solution at room temperature 1 minute at 5 A/dm$^2$ cathodically and subsequently anodically under the same conditions, rinsed well intermediately and gold plated in a commercial strongly acid gold bath. The gold coating was not removed even by strong scratching.

The entire disclosure of German priority application No. P 3020371.5 is hereby incorporated by reference.

What is claimed is:

1. A process for the pretreatment of stainless steel to make it adaptable to direct electrolytic gold plating in an acid gold plating bath having a pH below 3 comprising placing a stainless steel part in a cyanide containing aqueous solution consisting of water, an alkali hydroxide and alkali cyanide alone or together with at least one member of the group consisting of alkali metal phosphates, alkali metal condensed phosphates, alkali metal carbonates and alkali metal silicates and then treating the stainless steel first cathodically and then anodically.

2. In a process for electrolytically gold plating a stainless steel part in acid gold plating bath having a pH below 3 the improvement comprising pretreating the stainless steel part according to claim 1 prior to the step of gold plating.

3. A process according to claim 1 wherein the stainless steel part is treated cathodically at 2–40 A/dm$^2$ for 15 seconds to 5 minutes and then is treated anodically for 2–40 A/dm$^2$ for 15 seconds to 5 minutes.

4. In a process for electrolytically gold plating a stainless steel part in acid gold plating bath having a pH below 3 the improvement comprising pretreating the stainless steel part according to claim 3 prior to the step of gold plating.

5. A process according to claim 1 wherein the stainless steel part is treated at a temperature between 20° and 70° C.

6. In a process for electrolytically gold plating a stainless steel part in acid gold plating bath having a pH below 3 the improvement comprising pretreating the stainless steel part according to claim 5 prior to the step of gold plating.

7. A process according to claim 5 wherein the stainless steel part is treated cathodically at 2–40 A/dm$^2$ for 15 seconds to 5 minutes and then is treated anodically for 2–40 A/dm$^2$ for 15 seconds to 5 minutes.

8. In a process for electrolytically gold plating a stainless steel part in acid gold plating bath having a pH below 3 the improvement comprising pretreating the stainless steel part according to claim 7 prior to the step of gold plating.

9. A process according to claim 1 wherein an alkali cyanide is employed in a concentration of 2–100 grams/liter.

10. In a process for electrolytically gold plating a stainless steel part in acid gold plating bath having a pH below 3 the improvement comprising pretreating the stainless steel part according to claim 9 prior to the step of gold plating.

11. A process according to claim 9 wherein the stainless steel part is treated cathodically at 2–40 A/dm$^2$ for 15 seconds to 5 minutes and then is treated anodically for 2–40 A/dm$^2$ for 15 seconds to 5 minutes.

12. In a process for electrolytically gold plating a stainless steel part in acid gold plating bath having a pH below 3 the improvement comprising pretreating the stainless steel part according to claim 11 prior to the step of gold plating.

13. A process according to claim 9 wherein the cyanide is sodium cyanide or potassium cyanide.

14. In a process for electrolytically gold plating a stainless steel part in acid gold plating bath having a pH below 3 the improvement comprising pretreating the stainless steel part according to claim 13 prior to the step of gold plating.

15. A process according to claim 13 wherein the stainless steel part is treated cathodically at 2–40 A/dm$^2$ for 15 seconds to 5 minutes and then is treated anodically for 2–40 A/dm$^2$ for 15 seconds to 5 minutes.

16. A process according to claim 9 wherein the stainless steel part is treated at a temperature between 20° and 70° C.

17. In a process for electrolytically gold plating a stainless steel part in acid gold plating bath having a pH below 3 the improvement comprising pretreating the stainless steel part according to claim 16 prior to the step of gold plating.

18. A process according to claim 16 wherein the stainless steel part is treated cathodically at 2–40 A/dm$^2$ for 15 seconds to 5 minutes and then is treated anodically for 2–40 A/dm$^2$ for 15 seconds to 5 minutes.

19. In a process for electrolytically gold plating a stainless steel part in acid gold plating bath having a pH below 3 the improvement comprising pretreating the stainless steel part according to claim 18 prior to the step of gold plating.

* * * * *